US009382648B2

(12) United States Patent
Gielen

(10) Patent No.: US 9,382,648 B2
(45) Date of Patent: Jul. 5, 2016

(54) AIR-JET WEAVING MACHINE HAVING A COMPRESSED AIR SUPPLY DEVICE

(71) Applicant: Lindauer DORNIER GmbH, Lindau (DE)

(72) Inventor: Markus Gielen, Lindau (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 0 days.

(21) Appl. No.: 14/401,204

(22) PCT Filed: Apr. 24, 2013

(86) PCT No.: PCT/EP2013/058549

§ 371 (c)(1),
(2) Date: Nov. 14, 2014

(87) PCT Pub. No.: WO2013/171045

PCT Pub. Date: Nov. 21, 2013

(65) Prior Publication Data

US 2015/0129079 A1 May 14, 2015

(30) Foreign Application Priority Data

May 15, 2012 (DE) ..... 10 2012 208 158

(51) Int. Cl.
*D03D 47/30* (2006.01)
*D03D 47/00* (2006.01)

(52) U.S. Cl.
CPC ..... *D03D 47/3033* (2013.01); *D03D 47/3053* (2013.01)

(58) Field of Classification Search
CPC ..... D03D 47/3053; D03D 47/306; D03D 47/3033; D03D 51/085; D03D 51/44; D03D 47/3013; D03D 47/3026; D03D 47/304
See application file for complete search history.

(56) References Cited

U.S. PATENT DOCUMENTS 3,633,808 A * 1/1972 Svaty ..... 139/435.4
3,705,608 A * 12/1972 Vermeulen ..... 139/435.2
3,828,829 A * 8/1974 Gotoh et al. ..... 139/435.2

(Continued)

FOREIGN PATENT DOCUMENTS

EP 0 554 222 8/1993
EP 1 288 359 3/2003
EP 2 037 024 3/2009

OTHER PUBLICATIONS

International Search Report of the International Searching Authority for International Application PCT/EP2013/058549, mailed Mar. 5, 2014, 2 pages, European Patent Office, HV Rijswijk, Netherlands.

(Continued)

*Primary Examiner* — Bobby Muromoto, Jr.
(74) *Attorney, Agent, or Firm* — W. F. Fasse

(57) ABSTRACT

An apparatus for supplying compressed air to air-consuming components of an air-jet weaving machine includes plural pneumatically controllable pressure regulators (1.1, 1.2, 1.3), that each respectively have a pneumatic control inlet (3.1, 3.2, 3.3), plural electrically switchable valves (6.1, 6.2, 6.3) that are respectively connected to the pneumatic control inlets, an electrically controllable pressure regulator (4), and a control pressure line (5) that connects the outlet of the electrically controllable pressure regulator to the valves, and through the valves to the pneumatic control inlets of the pneumatically controllable pressure regulators.

7 Claims, 1 Drawing Sheet

(56) References Cited

U.S. PATENT DOCUMENTS

| | | | | | |
|---|---|---|---|---|---|
| 3,905,402 | A | * | 9/1975 | Jansa et al. | 139/435.2 |
| 3,977,443 | A | * | 8/1976 | Zahradnik et al. | 139/435.4 |
| 4,105,053 | A | * | 8/1978 | Fajfr | 139/435.4 |
| 4,143,682 | A | * | 3/1979 | Jansa et al. | 139/435.2 |
| 4,321,947 | A | * | 3/1982 | Cech et al. | 137/556 |
| 4,450,875 | A | * | 5/1984 | Simson et al. | 139/435.2 |
| 4,625,770 | A | * | 12/1986 | Ishikawa | 139/336 |
| 4,646,791 | A | * | 3/1987 | Tsuji et al. | 139/435.2 |
| 4,673,005 | A | * | 6/1987 | Kawajiri | 139/435.2 |
| 4,732,179 | A | * | 3/1988 | Takegawa | 139/435.2 |
| 4,781,224 | A | * | 11/1988 | Gotoh et al. | 139/435.2 |
| 4,877,064 | A | * | 10/1989 | Pezzoli | 139/435.1 |
| 4,895,188 | A | * | 1/1990 | Long | 139/439 |
| 5,067,527 | A | * | 11/1991 | de Jager | 139/435.2 |
| 5,094,275 | A | * | 3/1992 | Shaw et al. | 139/452 |
| 5,107,902 | A | * | 4/1992 | Wahhoud | 139/435.1 |
| 5,386,853 | A | * | 2/1995 | Speich | 139/1 C |
| 5,423,355 | A | * | 6/1995 | Greger et al. | 139/450 |
| 5,662,148 | A | * | 9/1997 | Jacobsson et al. | 139/450 |
| 5,699,673 | A | * | 12/1997 | Hoshino et al. | 62/93 |
| 5,746,256 | A | * | 5/1998 | Wahhoud et al. | 139/116.2 |
| 5,787,937 | A | * | 8/1998 | Teufel | 139/435.5 |
| 6,062,273 | A | * | 5/2000 | Peeters et al. | 139/435.2 |
| 6,109,309 | A | * | 8/2000 | Dornier et al. | 139/435.3 |
| 6,129,123 | A | * | 10/2000 | Ludwig et al. | 139/116.2 |
| 6,186,191 | B1 | * | 2/2001 | Dornier et al. | 139/435.1 |
| 6,439,271 | B2 | * | 8/2002 | Schiller et al. | 139/435.2 |
| 6,519,938 | B1 | * | 2/2003 | Foss | 60/410 |
| 6,739,357 | B2 | * | 5/2004 | Pedrini et al. | 139/452 |
| 6,748,981 | B2 | * | 6/2004 | Gielen et al. | 139/435.2 |
| 6,796,338 | B2 | * | 9/2004 | Baumann et al. | 139/435.2 |
| 2002/0005224 | A1 | * | 1/2002 | Schiller et al. | 139/435.1 |
| 2002/0170615 | A1 | * | 11/2002 | Gielen et al. | 139/435.2 |
| 2003/0000593 | A1 | * | 1/2003 | Pedrini et al. | 139/213 |
| 2003/0079792 | A1 | * | 5/2003 | Baumann et al. | 139/1 R |
| 2009/0065086 | A1 | * | 3/2009 | Jenne | 139/11 |
| 2009/0151806 | A1 | * | 6/2009 | Jameson et al. | 139/435.2 |
| 2009/0288732 | A1 | * | 11/2009 | Gielen | 139/435.3 |
| 2015/0129079 | A1 | * | 5/2015 | Gielen | 139/435.2 |

OTHER PUBLICATIONS

PCT International Preliminary Report on Patentability including English Translation of PCT Written Opinion of the International Searching Authority for International Application PCT/EP2013/058549, issued Nov. 18, 2014, 7 pages, International Bureau of WIPO, Geneva, Switzerland.

* cited by examiner

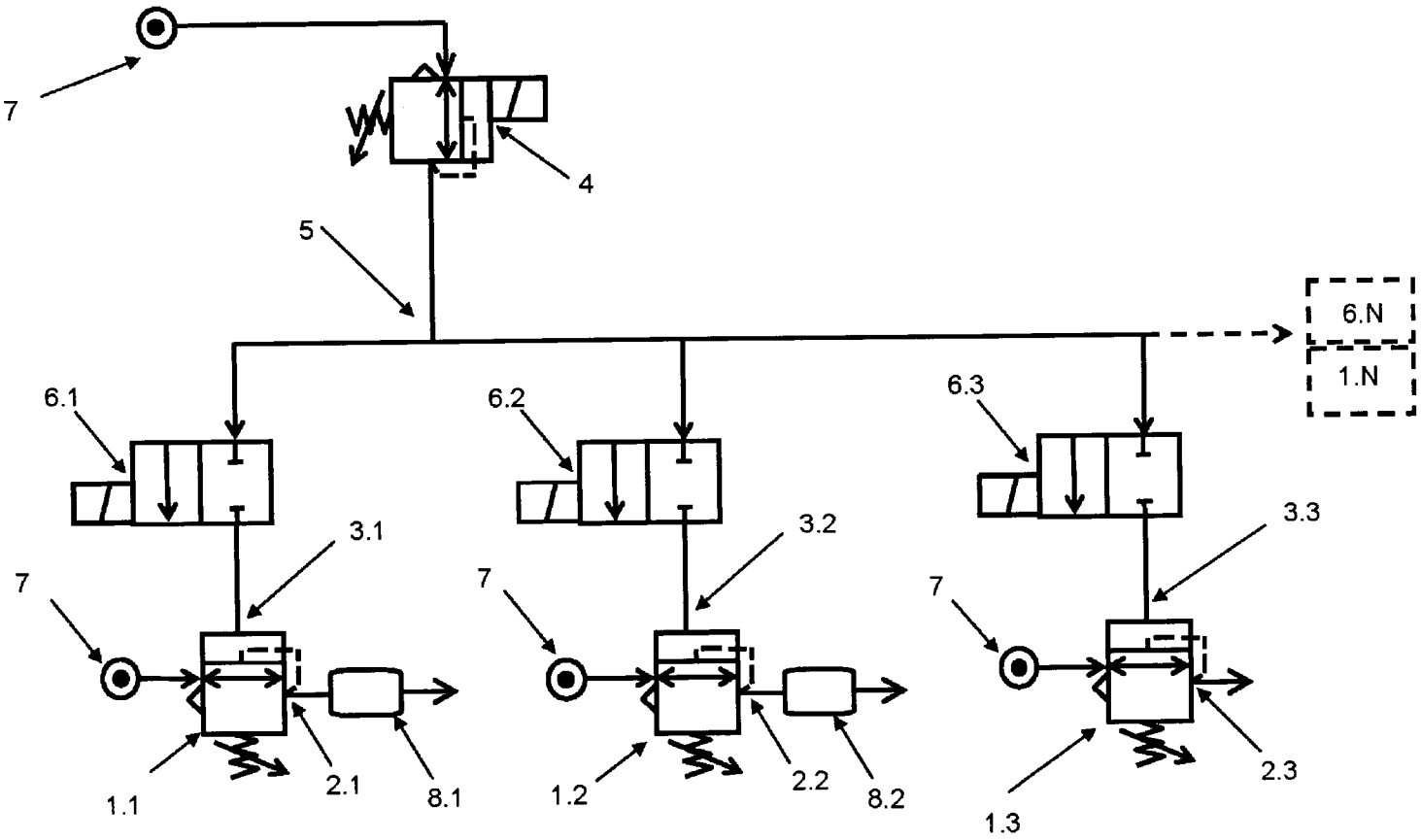
6.N
1.N
3.3
2.3
6.3
1.3
7
8.2
3.2
2.2
6.2
1.2
7
4
5
8.1
3.1
2.1
6.1
1.1
7
7

AIR-JET WEAVING MACHINE HAVING A COMPRESSED AIR SUPPLY DEVICE

FIELD OF THE INVENTION

The present invention relates to an air-jet weaving machine with an apparatus or device for the supply of compressed air.

BACKGROUND INFORMATION

An air-jet weaving machine with an apparatus for the supply of compressed air is shown, for example, by the EP 1 288 359 A1. This discloses an air-jet weaving machine with various different compressed air supply components, which are supplied with compressed air from a supply network via a central compressed air supply line and an internal compressed air distribution line. Several pressure regulators or controllers, or pressure reduction valves, are connected to the internal compressed air distribution line. The pressure regulators are controlled or adjustable in a pneumatic or motorized manner. For electronically adjusting or setting various different air pressures for various different groups of air nozzles, it is suggested in the EP 1 288 359 A1, to allow each group of air nozzles to be actuated by respectively one motor-controlled pressure regulating valve, which is allocated to this group, in connection with a pneumatically controlled pressure regulating valve. Such an arrangement is expensive and complex in its construction.

SUMMARY OF THE INVENTION

In view of the above, at least one embodiment of the present invention has an object of using only a single electrically controlled pressure adjusting means for the electronic adjusted setting of various different air pressures for various different groups of air nozzles or other air consumers on an air-jet weaving machine.

The above object can be achieved by an air-jet weaving machine with an apparatus or device according to at least one embodiment of the present invention.

The air-jet weaving machine has several pneumatically adjustable pressure regulators. Such pressure regulators generally have inlets for the supply air and for a pneumatic control pressure, as well as a pneumatic outlet. The various different air pressures—for example for the supply of air nozzles or of various different groups or types of air nozzles—are adjustable in that various different control pressures are applied at the pneumatic control inlet of the pneumatically adjustable pressure regulator.

Such pneumatically adjustable pressure regulators or pressure reduction valves are known to the worker skilled in the art. Upon the application of a certain pneumatic control pressure at the control inlet, these devices reduce and regulate the air pressure from the central compressed air supply line or from the internal compressed air distribution line of the weaving machine, to a constant value at the pneumatic outlet of the pressure regulator.

The air-jet weaving machine further has an electrically controllable pressure adjusting means with a pneumatic outlet. Such electrically controllable pressure adjusting means are known to the worker skilled in the art, for example as a motor-controlled pressure reducing valve from the EP 1 288 359 A1.The motor moves an adjusting member or control element in the pressure reducing valve or pressure regulator, and via this adjusting member or control element the air pressure from a central compressed air supply line or from the internal compressed air distribution line of the weaving machines is reduced and regulated to a constant value at the pneumatic outlet of the electrically controlled pressure regulator.

Instead of a motor, of course other principles (magnetic, piezoelectric, etc.) for the electrical control of the pressure regulator, as known to the person skilled in the art, are also possible.

The electrical actuation generally is achieved via the weaving machine controller. According to the invention, a control pressure line is present, in which various different air pressures or control pressures are producible by the electrically controllable pressure adjusting means. Furthermore, several electrically switchable valves are present, which are respectively allocated to a pneumatic control inlet of the pneumatic pressure regulator.

Via these electrically switchable valves, respectively one associated pneumatic control inlet can be connected with the control pressure line. Generally, during operation of the air-jet weaving machine, one valve after the other is opened so that respectively always only one of the pneumatic control inlets is connected with the control pressure line.

That means that the current control pressure that is present in the control pressure line, is applied at the control inlet of a pneumatically adjustable pressure regulator at the moment in which the associated electrically switchable valve is opened. By opening and closing the valves after adjusted setting of various different pressures in the control pressure line, the various different pneumatically adjustable pressure regulators can be supplied with the respective suitably matched or adapted control pressure at the pneumatic control inlet. The valves can be actuated originating from the weaving machine controller at the time points that are required for the desired pressure sequence or progression in the control pressure line and at the connected pressure regulators.

If various different control pressures are needed for various different groups of air nozzles, then each one of these groups can have its own pneumatically adjustable pressure regulator allocated to it. By electronically adjusting various different control pressures in the control pressure line and by opening the various different valves respectively circuit-connected before a pneumatically adjusted pressure regulator, thereby respective various different air pressures—for example for various different groups of air nozzles—can be adjustedly set at the pneumatically adjustable pressure regulators. For that, however, only a single electrically controllable pressure adjusting means—thus for example an electrically adjustable pressure regulator—and an additional electrically switchable valve for each group of air nozzles, are needed. The valves—e.g. magnetic valves—suitable for that are considerably simpler in construction, simpler to control or actuate, and considerably less expensive than electrically adjustable pressure regulators.

In order to be able to adjustingly set various different pressures for various different groups of air nozzles in a simple type and manner, generally an electronic weaving machine controller with an input device for the various different air pressures for supplying the air nozzles is to be provided. Of course, the associated values for the adjusting of the pressures can also be read-in or loaded from an external or internal memory storage medium and processed in the controller.

In order to be able to carry out the described advantageous time progression or sequence of the valve control, it is advantageous if the weaving machine controller comprises electronic means, with which the pneumatic control inlets of the pneumatically adjustable pressure regulator can be connected with the control pressure line via the electrically switchable valves at prescribed time points.

BRIEF DESCRIPTION OF THE DRAWING

FIG. 1 Schematic illustration of an example embodiment of the apparatus for the compressed air supply of the air-jet weaving machine according to the invention.

DETAILED DESCRIPTION OF EXAMPLE EMBODIMENTS OF THE INVENTION

FIG. 1 shows an embodiment of the apparatus for the compressed air supply of the air-jet weaving machine according to the invention. The air-jet weaving machine comprises a compressed air distribution network 7, through which the components in the air-jet weaving machine are supplied with compressed air from an external supply network. In the present example, there are three pneumatically adjustable pressure regulators 1.1, 1.2, 1.3, of which the supply inlets are supplied or fed from the compressed air distribution network 7. Each pneumatically adjustable pressure regulator 1.1, 1.2, 1.3 comprises a pneumatic outlet 2.1, 2.2, 2.3 and a pneumatic control inlet 3.1, 3.2, 3.3. From the outlets 2.1, 2.2, 2.3, the compressed air is further directed to various different air consumers. In the case of the pneumatically adjustable pressure regulators 1.1 and 1.2, these are two different groups of air nozzles (not illustrated) for the weft insertion on the air-jet weaving machine. Additionally, respectively one air tank 8.1 or 8.2 and non-illustrated valves are located between the air nozzles and the outlets 2.1, 2.2 of the associated pneumatically adjustable pressure regulators 1.1, 1.2.

In the present example, a non-illustrated air consuming element without an additional air tank is connected at the outlet 2.3 of the third pneumatically adjustable pressure regulator 1.3.

The pneumatically adjustable pressure regulators 1.1, 1.2, 1.3 respectively comprise a pneumatic control inlet 3.1, 3.2, 3.3. Upon applying control pressures with various different magnitudes to these control inlets 3.1, 3.2, 3.3, the air pressures at the outlets 2.1, 2.2, 2.3 of the pneumatically adjustable pressure regulators 1.1, 1.2, 1.3 are regulated to air pressure values with various different magnitudes.

A single electrically adjustable pressure regulating valve 4 is provided for adjustingly setting control pressures with various different magnitudes for the pneumatic control inlets 3.1, 3.2, 3.3 of all present pneumatically adjustable pressure regulators 1.1, 1.2, 1.3. This electrically adjustable pressure regulating valve 4, in the example embodiment, is embodied motor-adjustable in a known type and manner, whereby the motor obtains its control signals from a non-illustrated weaving machine controller. Additionally, an input possibility (not illustrated) for the various air pressures required at the outlets of the pneumatically adjustable pressure regulators 1.1, 1.2, 1.3 is provided on the weaving machine controller.

The weaving machine controller is embodied or configured in such a manner so that a sequence of various different air pressure values is produced in a predetermined time sequence or progression in the control pressure line 5—that is to say at the outlet of the electrically adjustable pressure regulator 4. Every time when one of these air pressure values is present at the outlet of the electrically adjustable pressure regulator 4 and therewith in the control pressure line 5, an electrically switchable valve 6.1, 6.2, 6.3 is opened, which connects the control pressure line 5 with the pneumatic control inlet 3.1, 3.2, 3.3 of a pneumatically adjustable pressure regulator 1.1, 1.2, 1.3. Via the now-prevailing or applied control pressure, the outlet pressure of the pneumatically adjustable pressure regulator 1.1, 1.2, 1.3 is adjustedly set. Next the electrically switchable valve 6.1, 6.2, 6.3 is closed, the electrically adjustable pressure regulator 4 is adjustedly set to a new value prescribed by the weaving machine controller, and the next electrically switchable valve 6.1, 6.2, 6.3 is opened. Thereby the next pneumatically adjustable pressure regulator 1.1., 1.2, 1.3 is adjustedly set to a prescribed air pressure value at its outlet 2.1, 2.2, 2.3. Other time sequences or progressions of the switching processes, such as for example simultaneous switching of several electrically switchable valves, is possible if necessary via corresponding programming of the weaving machine controller.

It is directly possible without further efforts, to provide further pneumatically adjustable pressure regulators 1.N, which can be connected via correspondingly allocated further electrically switchable valves 6.N with the control pressure line 5 or with the electrically adjustable pressure regulator 4 (dashed lines in FIG. 1). In this manner, various different air pressures for various different air nozzles of an air-jet weaving machine can be electronically adjusted and set with a single electrically adjustable pressure regulator 4 by corresponding inputs into the weaving machine controller.

REFERENCE NUMBERS

1.1 pneumatically adjustable pressure regulator
1.2 pneumatically adjustable pressure regulator
1.3 pneumatically adjustable pressure regulator
2.1 outlet, pneumatic pressure regulator
2.2 outlet, pneumatic pressure regulator
2.3 outlet, pneumatic pressure regulator
3.1 pneumatic control inlet, pressure regulator
3.2 pneumatic control inlet, pressure regulator
3.3 pneumatic control inlet, pressure regulator
4 electrically adjustable pressure regulator
5 control pressure line
6.1 electrically switchable valve
6.2 electrically switchable valve
6.3 electrically switchable valve
7 internal compressed air distribution network of the weaving machine
8.1 compressed air tank
8.2 compressed air tank

The invention claimed is:

1. An apparatus for supplying compressed air to air-consuming components of an air-jet weaving machine that includes a compressed air supply, said apparatus comprising:

an electrically controllable pressure regulator having an air inlet to be connected to the compressed air supply of the weaving machine, a regulated control pressure outlet, and an electrical control signal input;

a plurality of electrically switchable valves, that each respectively have a respective air inlet, a respective switched air outlet, and a respective electrical switching signal input, wherein said respective air inlets of said electrically switchable valves are connected in common to said regulated control pressure outlet of said electrically controllable pressure regulator, and a plurality of pneumatically controllable pressure regulators that each respectively have a respective supply air inlet to be connected to the compressed air supply of the weaving machine, a respective regulated air outlet to be connected to a respective one or more of the air-consuming components of the weaving machine, and a respective pneumatic control inlet, wherein said pneumatic control inlets of said pneumatically controllable pressure regulators are connected respectively to respective ones of said switched air outlets of said electrically switchable valves.

2. The apparatus according to claim 1, further comprising a weaving machine controller having electrical signal outputs electrically connected to said electrical control signal input of said electrically controllable pressure regulator and to said electrical switching signal inputs of said electrically switchable valves.

3. The apparatus according to claim 2, wherein said weaving machine controller is configured and adapted to provide an electrical control signal to said electrical control signal input of said electrically controllable pressure regulator, said electrically controllable pressure regulator is configured and adapted to produce at said regulated control pressure outlet a pneumatic control pressure that is regulated in response to and dependent on said electrical control signal, said weaving machine controller is further configured and adapted to provide electrical switching signals to said electrical switching signal inputs of said electrically switchable valves, and said electrically switchable valves are each respectively configured and adapted to open and close a pneumatic connection between said respective air inlet and said respective switched air outlet of said respective electrically switchable valve in response to and dependent on a respective one of said electrical switching signals provided to said electrical switching signal input of said respective electrically switchable valve.

4. The apparatus according to claim 3, wherein said weaving machine controller is further configured and adapted to vary and sequence said electrical control signal, and to sequence said electrical switching signals, such that said pneumatic control inlets of said pneumatically controllable pressure regulators are pneumatically connected respectively through connected ones of said electrically switchable valves to said regulated control pressure outlet of said electrically controllable pressure regulator respectively at different times at which different values of said pneumatic control pressure prevail at said regulated control pressure outlet.

5. The apparatus according to claim 1, wherein said electrically switchable valves are two-position on-off valves.

6. An apparatus for supplying compressed air to air-consuming components of an air-jet weaving machine, said apparatus comprising:

plural pneumatically controllable pressure regulators that each have a respective pneumatic control inlet, and that each have a respective regulated air outlet to be connected to a respective one or group of said air-consuming components;

one electrically controllable pressure regulator that has one regulated control pressure outlet; and plural electrically switchable valves that are respectively pneumatically connected and interposed between said one regulated control pressure outlet of said one electrically controllable pressure regulator and said pneumatic control inlets of said plural pneumatically controllable pressure regulators.

7. The apparatus according to claim 6, wherein the weaving machine includes a compressed air supply and an electronic controller, said electrically controllable pressure regulator and said electrically switchable valves are electrically connected to the electronic controller, and said electrically controllable pressure regulator and said pneumatically controllable pressure regulators are pneumatically connected to the compressed air supply.

* * * * *